US012796795B2

(12) United States Patent
Short

(10) Patent No.: US 12,796,795 B2
(45) Date of Patent: Nov. 17, 2026

(54) SOLUTION DISPENSING HAIRCARE SYSTEM

(71) Applicant: Miona Grae Short, Chicago, IL (US)

(72) Inventor: Miona Grae Short, Chicago, IL (US)

( * ) Notice: Subject to any disclaimer, the term of this patent is extended or adjusted under 35 U.S.C. 154(b) by 49 days.

(21) Appl. No.: 18/649,624

(22) Filed: Apr. 29, 2024

(65) Prior Publication Data

US 2024/0358134 A1 Oct. 31, 2024

Related U.S. Application Data

(60) Provisional application No. 63/498,979, filed on Apr. 28, 2023.

(51) Int. Cl.
*A45D 24/22* (2006.01)
*A46B 11/00* (2006.01)

(52) U.S. Cl.
CPC ..... *A45D 24/22* (2013.01); *A46B 11/001* (2013.01); *A46B 2200/104* (2013.01)

(58) Field of Classification Search
CPC ..... A45D 19/026; A45D 24/22; A45D 24/24; A45D 24/26; A46B 11/001; A46B 11/0041
See application file for complete search history.

(56) References Cited

U.S. PATENT DOCUMENTS

| | | | | | |
|---|---|---|---|---|---|
| 2,585,561 | A * | 2/1952 | Lattuca | A45D 24/24 | 132/148 |
| 2,694,401 | A * | 11/1954 | Francis | A45D 24/26 | 285/331 |
| 4,090,522 | A * | 5/1978 | Donley | A45D 24/22 | 164/415 |
| 4,319,852 | A * | 3/1982 | Bell | A45D 24/22 | 401/278 |
| 5,337,764 | A * | 8/1994 | Mckay | A45D 24/24 | 132/114 |
| 2015/0157108 | A1* | 6/2015 | Roberts | A45D 24/22 | 132/116 |

* cited by examiner

*Primary Examiner* — Rachel R Steitz
(74) *Attorney, Agent, or Firm* — UB Greensfelder LLP; Benjamin D. Rotman

(57) ABSTRACT

The present invention is directed to a solution dispensing haircare system comprising a comb body, a fluid reservoir, and a comb or styling tool coupled to the comb body. The comb body or fluid reservoir may comprise a compressible protrusion to discharge a fluid or haircare solution from the fluid reservoir onto the hair. The comb or styling tool may be modular and removably coupled to the comb body.

20 Claims, 9 Drawing Sheets

SOLUTION DISPENSING HAIRCARE SYSTEM

CROSS-REFERENCE TO RELATED APPLICATIONS

This application claims the benefit of U.S. Provisional Application No. 63/498,979, filed Apr. 28, 2023. The foregoing patent disclosure is incorporated by this reference thereto.

BACKGROUND OF THE INVENTION

The present invention generally relates to the field of hair care products. More particularly, the invention relates to a solution dispensing hair system and method of use.

Hair combs and brushes are typically used as a key part of the haircare maintenance process. To manage the distinct needs of various hair types, the hair and beauty industries have focused on providing hair products and solutions (like creams, oils, gels, and other liquids) to tend to the needs of the consumer. The use of these products often adds more steps to the haircare process in such a way that makes it longer and more cumbersome.

Dispensing systems integrating combs or brushes have been developed to dispense various fluids onto the hair or scalp. However, few of these dispensing systems do so in a manner that helps the consumer consolidate the steps of typically multilayered haircare routines. Many systems feature complex tools and steps that complicate the user experience. Further, these systems rarely consider the needs of curly and afro-textured hair.

Much of the prior art emphasizes the need for concurrent product distribution with hair styling elements, such as teeth or bristles. These prior art designs, however, do not take into account the obstruction of product flow as a buildup of hair or dried product may clog the distribution channels. This has an adverse impact on both the consumer experience as well as the efficacy of the prior art as the ability for hair product to reach the hair shaft decreases as a function of time. Further, much of the prior art features static styling elements, which do not allow consumers to explore different options within the scope of the tool as their haircare needs may change over time. For example, lifestyle changes such as stress, or hormonal changes may cause the consumer to need a more comb-like apparatus in one season of their life, while at another time, needing a more flexible brush-like apparatus.

The present invention attempts to remedy the shortcomings of the previous systems.

SUMMARY OF THE INVENTION

In light of the foregoing a solution dispensing haircare system that is to dispense product, clean, and change styling tools or haircare tools is provided.

In a first aspect, the solution dispensing haircare system comprises a comb body, a handle extending from comb body, a fluid reservoir coupled to the comb body, and a comb tool extending from or coupled to the comb body. The comb tool may comprise a plurality of teeth like a standard comb, or the comb tool may include but is not limited to any hair or scalp treatment or styling tool such as a brush or a clip. In one example the handle, the fluid reservoir, and the comb tool are integrally coupled to, or are formed as part of the comb body. In other examples the handle, the fluid reservoir, or the comb tool are removably coupled to the comb body.

In yet another aspect the fluid reservoir is fluidly coupled to at least one fluid distribution channel configured to deliver fluid solution from the fluid reservoir to the hair. The distribution channels may be sealed in a first state by a closure mechanism in a first position, and open in a second state when the closure mechanism is in a second position. In this aspect the closure mechanism may be coupled to the handle and rotate or pivot to an open and closed position, it may slide to an open and closed position, or may be inserted and removed from the distribution channels. Flow control may be accomplished by rotating or sliding the closure mechanism into a partially open or fully open position, or by inserting the closure mechanism into some of but not all of the distribution channels. It is to be recognized by one of skill in the art that the fluid reservoir is configured to hold fluid or other viscous solutions including but not limited to creams, oils, and gels.

In another aspect, the handle further comprises a compressible protrusion. The compressible protrusion is disposed adjacent to the fluid reservoir and is configured to compress the fluid reservoir to discharge fluid or solution from the fluid reservoir through the distribution channels.

In one aspect, a method for treating hair using a solution dispensing haircare system comprises the steps of obtaining a solution dispensing haircare system comprising a fluid reservoir coupled to a comb body, a handle extending from the comb body, and a comb tool extending from the comb body, wherein the comb body or fluid reservoir comprises a compressible protrusion, the fluid reservoir is fluidly coupled to at least one fluid distribution channel, and the fluid reservoir is coupled to a closure mechanism; filling the fluid reservoir with a haircare solution; opening the closure mechanism unsealing the at least one distribution channel; applying the comb tool to hair; compressing the compressible protrusion and dispensing the haircare solution through the distribution channel to hair; applying the haircare solution to the hair with the comb tool; and closing the closure mechanism to seal the at least one distribution channel.

The methods, systems, apparatuses are set forth in part in the description which follows, and in part will be obvious from the description, or can be learned by practice of the methods, apparatuses, and systems. The advantages of the methods, apparatuses, and systems will be realized and attained by means of the elements and combinations particularly pointed out in the appended claims. It is understood that both the foregoing general description and the following detailed description are exemplary and explanatory only and are not restrictive of the methods, apparatuses, and systems, as claimed.

BRIEF DESCRIPTION OF THE DRAWINGS

In the accompanying figures, like elements are identified by like reference numerals among the several preferred embodiments of the present invention.

Other aspects and advantages of the present invention will become apparent upon consideration of the following detailed description, wherein similar structures have similar reference numerals.

DETAILED DESCRIPTION OF THE PREFERRED EMBODIMENTS

The foregoing and other features and advantages of the invention will become more apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Figure 1:
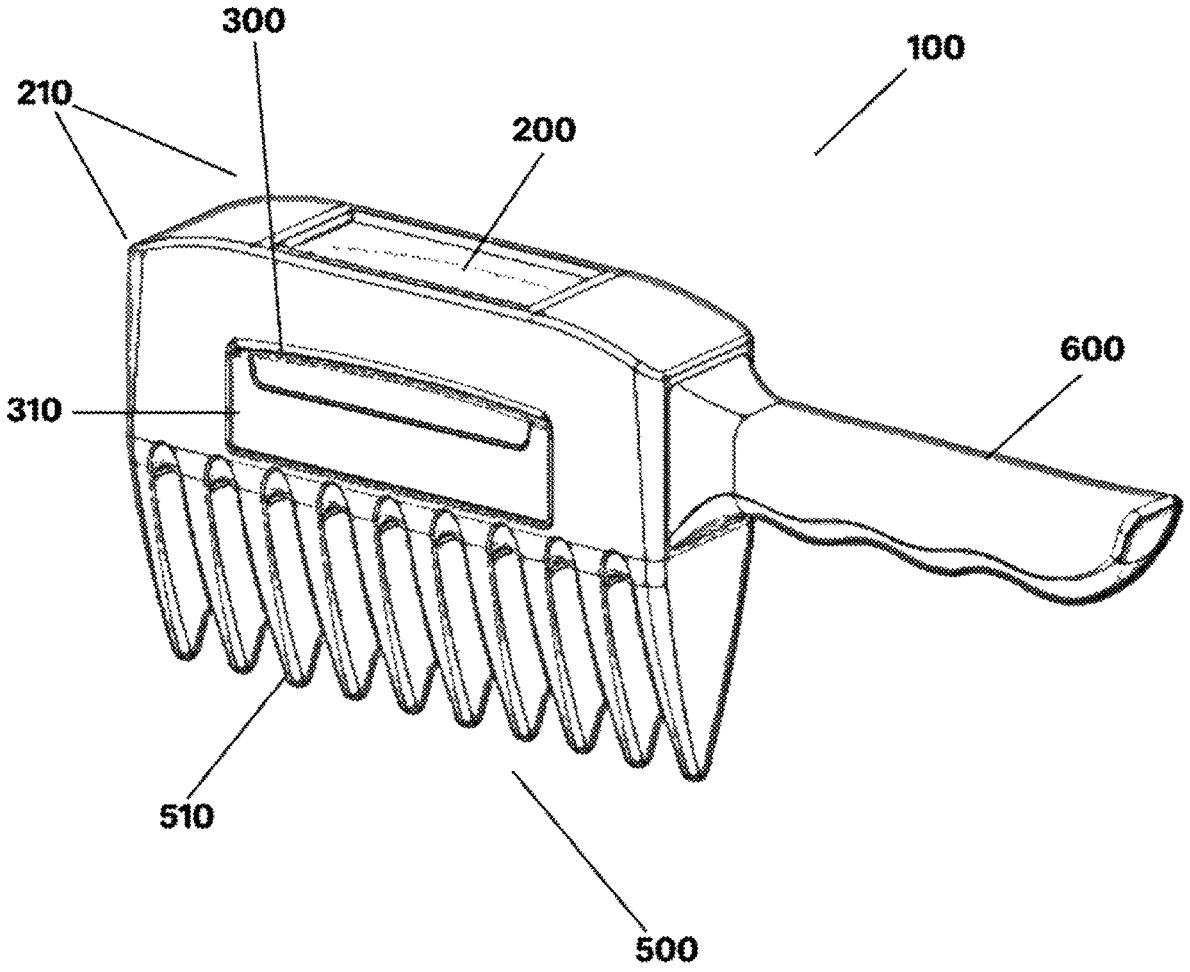
FIG. 1 illustrates an example perspective side view of the haircare system showing a closure mechanism and land on the comb.
Figure 2:
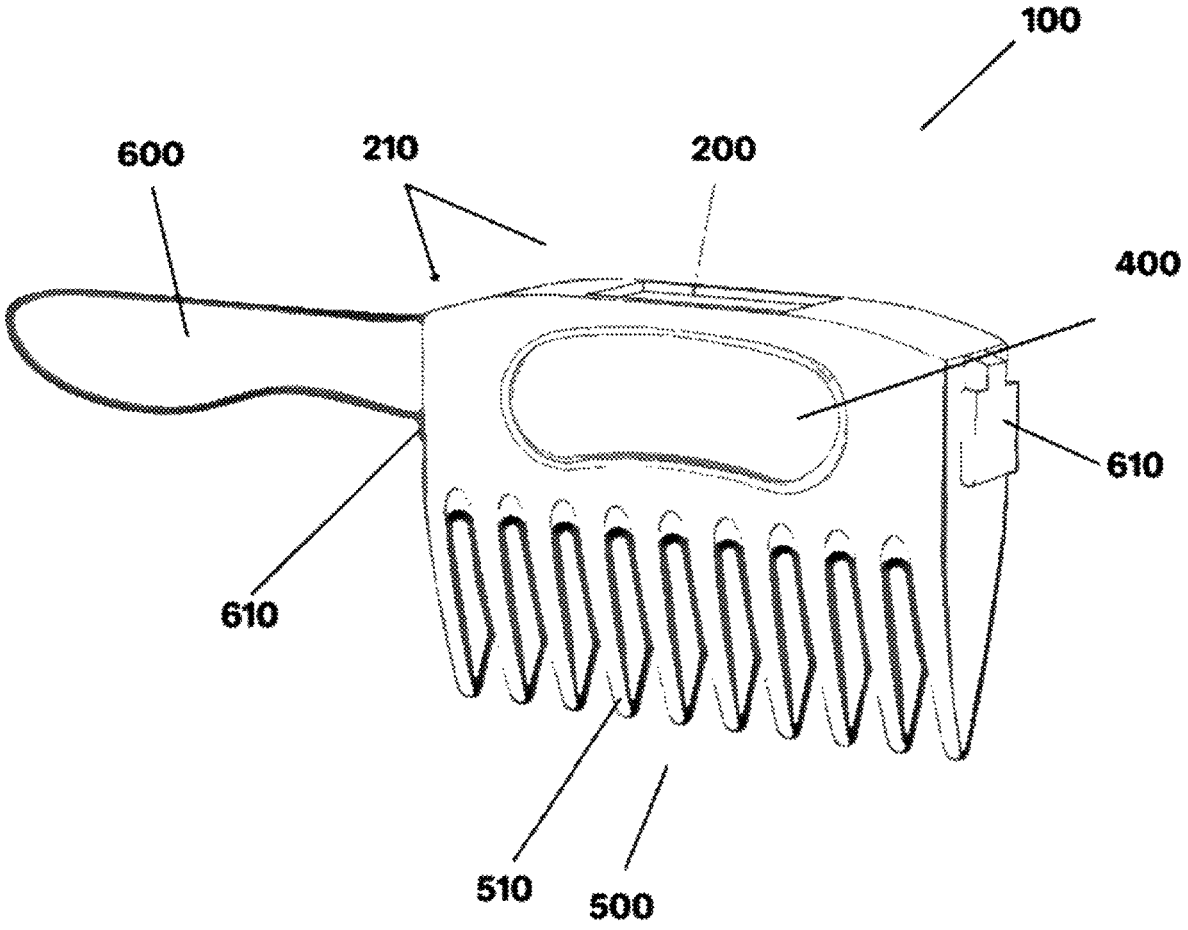
FIG. 2 illustrates an example perspective side view of the haircare system showing a compressible protrusion on the comb body, a handle, and handle docks.
Figure 3:
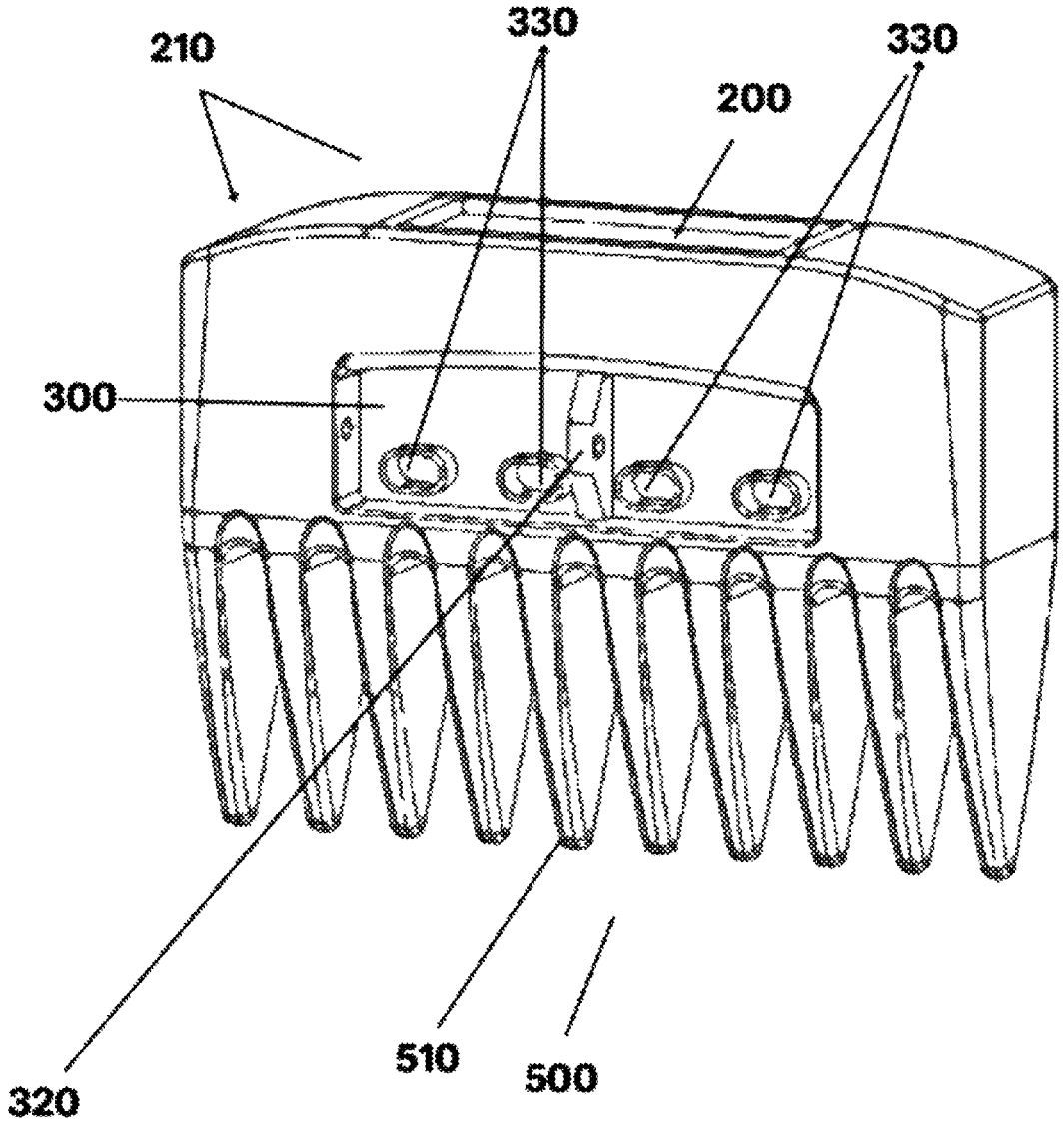
FIG. 3 illustrates an example perspective side view of the haircare system showing a land, structural rib, and distribution channels within the comb body.
Figure 4:
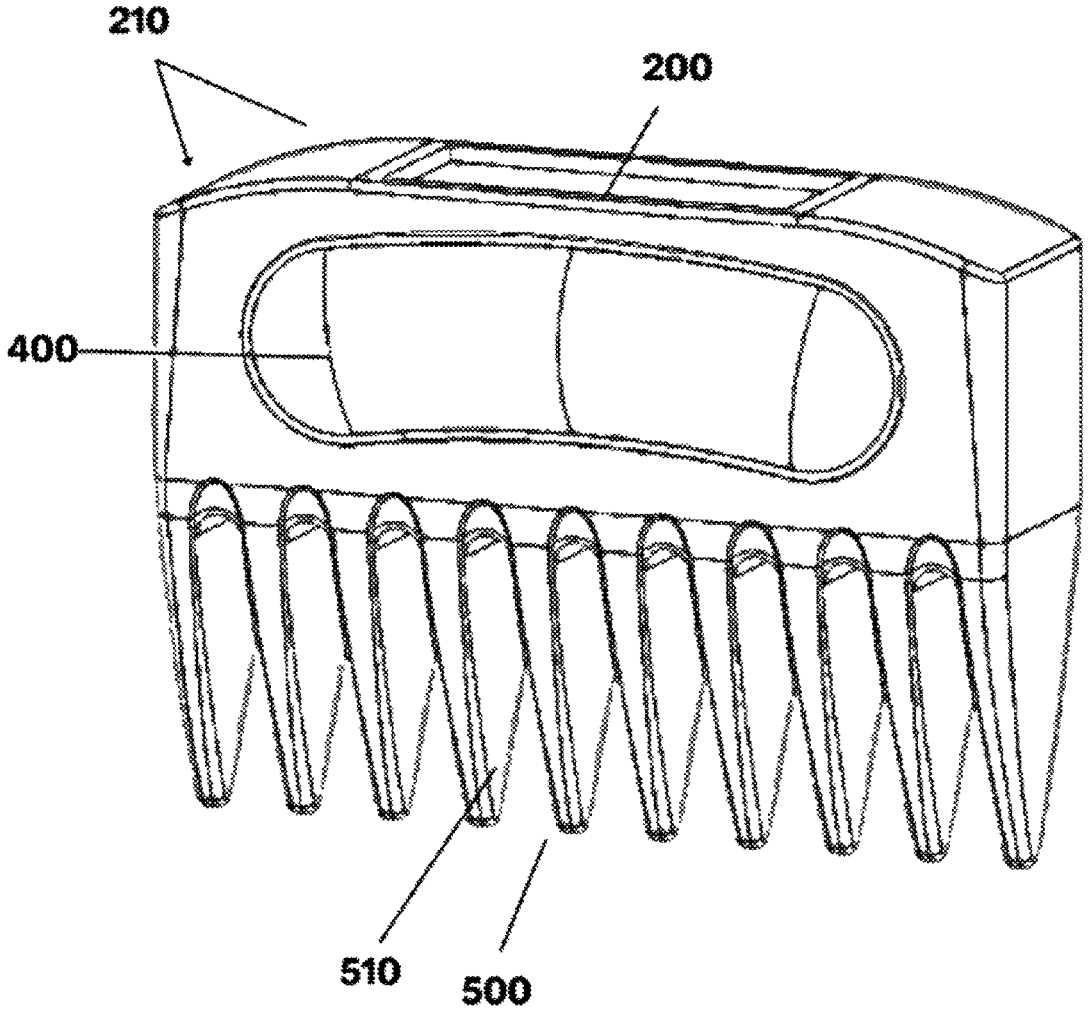
FIG. 4 illustrates an example perspective side view of the haircare system showing a compressible protrusion on the comb body.

As illustrated in FIG. 1 and FIG. 2 the solution dispensing haircare system 100 comprises a comb body 210, a handle 600 extending from comb body 210, a fluid reservoir 200 coupled to the comb body 210, and a comb tool 500 extending from or coupled to the comb body 210. The comb tool 500 may comprise a plurality of teeth 510 like a standard comb, or the comb tool may include but is not limited to any hair treatment tool or haircare styling tool such brush or a clip. The comb tool 500 comprises a comb tool width from a first lateral side to the second lateral side of the comb tool 500. In one example the handle 600, the fluid reservoir 200, and the comb tool 500 are integrally coupled to, or are formed as part of the comb body 210. In other examples the handle 600, the fluid reservoir 200, or the comb tool 500 are removably coupled to the comb body 210. FIG. 3 and FIG. 4 show alternate system embodiments without handle 600 or in which handle 600 is removably coupled to the comb body 210.

The comb body 210 may comprise a comb body front surface, a comb body rear surface, a comb body top surface, a comb body bottom surface, and two comb body lateral surfaces. The comb tool 500 may be coupled to the comb body bottom surface. In certain embodiments, as discussed further below, the comb handle 600 may be coupled to the comb body front surface, comb body rear surface, or comb body top surface As further shown in FIG. 3, haircare system 100 enables solutions of various viscosities to be discharged from the fluid reservoir 200 onto the hair. In one example, the fluid reservoir 200 may be fluidly coupled to at least one fluid distribution channel 330. The fluid distribution channel 330 may be integral to the comb body 210 or may be an extension of the fluid reservoir 200. The fluid distribution channel 330 may be disposed on a lateral side of the comb body 210 such that fluid or haircare solution may be discharged from the fluid reservoir 200 onto the hair through the inertial motion of the system 100 and gravity while in use.

The fluid reservoir may be opened for cleaning or refilling or sealed through a fluid reservoir lid 220 coupled to the fluid reservoir 200 itself or the comb body 210. The fluid reservoir lid 220 may be disposed on the top or lateral sides of the fluid reservoir 200 or comb body 210.

Figure 11:
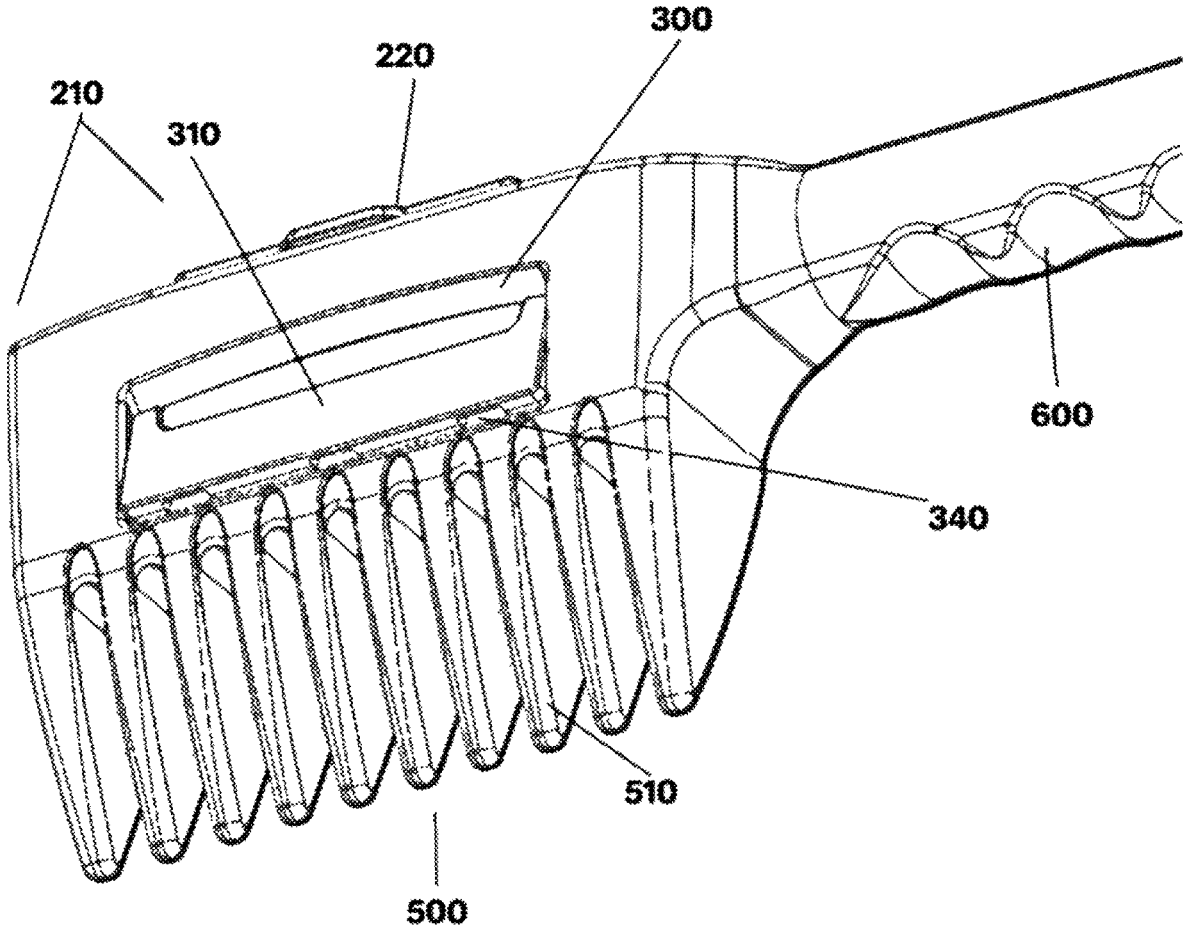
FIG. 11 illustrates an example perspective side view of the haircare system showing a handle, a closed lid, a closure mechanism, and ducts within the comb body.

As shown in FIG. 11, the fluid distribution channels 330 may be sealed, opened, or partially opened through a closure mechanism 310. Closure mechanism 310 may be coupled to the fluid reservoir 200 itself or the comb body 210. As shown in FIG. 11, closure mechanism 310 may comprise fluid ducts 340 fluidly coupled to the fluid distribution channels 330. In one aspect, the closure mechanism 310 is rotatably coupled to the fluid reservoir 200 or the comb body 210 and in a first closed state the closure mechanism 310 covers and seals the fluid distribution channels while in a second rotated state, a top portion of the closure mechanism 310 is rotated into the comb body 210 exposing a comb body land 300 and unsealing the fluid distribution channels 330 and exposing the fluid ducts 340. In this aspect, fluid or solution flow may be controlled through the amount of rotation of the closure mechanism 310 and exposure of the fluid ducts 340. In other aspects, not shown, the closure mechanism 310 may be configured to slide or translate up and down the comb body 210 exposing and sealing portions of the fluid distribution channels 330. In additional aspects, not shown, the closure mechanism 310 may comprise removable seals or grommets placed into the fluid distribution channels 330 and held by a compression fit.

Referring to FIGS. 1, 3, 5, 9-11, the land 300 comprises a cavity in the comb body 210 where closure mechanism 310 may be attached in order to facilitate the sealing or distribution of solutions housed within fluid reservoir 200. The land 300 may include one or more distribution channels 330 that are fluidly coupled with fluid reservoir 200. The comb body 210 may feature various kinds of seals, including but not limited to crab claw seals and bore seals, in order to close the fluid distribution channels 330 and provide protection against leakage from fluid reservoir 200. In some constructions, such as in FIGS. 3, 5, land 300 may include one or more ribs 320 to add rigidity to or provide support for the structure of comb body 210 or closure mechanism 310. The closure mechanism 310 and land 300 may be of a variety of concentric, corresponding shapes. FIGS. 1 and 11 illustrate the land 300 and closure mechanism 310 in corresponding rectangular configurations. Further embodiments of land 300 and closure mechanism 310 may include but are not limited to concentric, corresponding circular and triangular configurations or those of any other shapes. The size of land 300 and the closure mechanism 310 and its further constructions may be as small as 0.25 inches in diameter, length, or width and extend in size to the length and width of comb body 210. In other embodiments, the closure mechanism 310 may be replaced with a flip top mechanism. In other constructions, closure mechanism 310 may be replaced by a sliding door that opens and closes the land 300 when the consumer slides the door from one side to another. In another embodiment of comb body 210, the fluid distribution channels 330 of land 300 may protrude beyond the plane of comb body 210 in order to directly distribute solution onto the consumer's hair.

In other aspects, as shown in FIG. 4, the system 100, further comprises a compressible protrusion 400 coupled to the fluid reservoir 200. The compressible protrusion 400 may be a separate component coupled to the comb body 210 configured to provide a compressive force onto the fluid reservoir 200, or the compressible protrusion 400 may be a component of the fluid reservoir 200. When the compressible protrusion 400 is pressurized, most often by squeezing, then solution is dispelled out the fluid distribution channels 330. In some configurations as shown in FIG. 2, the compressible protrusion 400 is disposed on a lateral side of the comb body 210 opposite the distribution channels 330, in other configurations, the compressible protrusion 400 may be disposed on a top surface or front surface of the comb body 210.

Referring to FIGS. 2, 4, 7, 8, the compressible protrusion 400 enables manual pressurization of the fluid reservoir 200 in order for solutions to be dispensed through the fluid distribution channels 330 and in some examples out the external ducts 340 within closure mechanism 310. In other constructions, the compressible protrusion 400 may be replaced by a flexible or resilient material that does not protrude beyond the plane of the comb body 210. Further embodiments may see the compressible protrusion 400 replaced by or inclusive of at least one button that can pressurize the fluid reservoir 200 or other elements retained by comb body 210. Such buttons may be of flexible or resilient plastic, metal, or biodegradable material. Compressible protrusion 400 may be attached to system 100 using a variety of molding, welding, or bonding methods, including but not limited to overmolding onto system 100 or ultrasonic bonding. In some aspects, compressible protrusion 400 may also be removably coupled from comb body 210. In such embodiments, compressible protrusion 400 may doubly function as lid 220 such that compressible protrusion 400 may function as both a pressurization mechanism for fluid reservoir 200 and a removable sealant for the entry and exit of solutions. The size of the compressible protrusion 400 and its further constructions may be as small as 0.25 inches in length and width and as large as the length and width of comb body 210.

Figure 6:
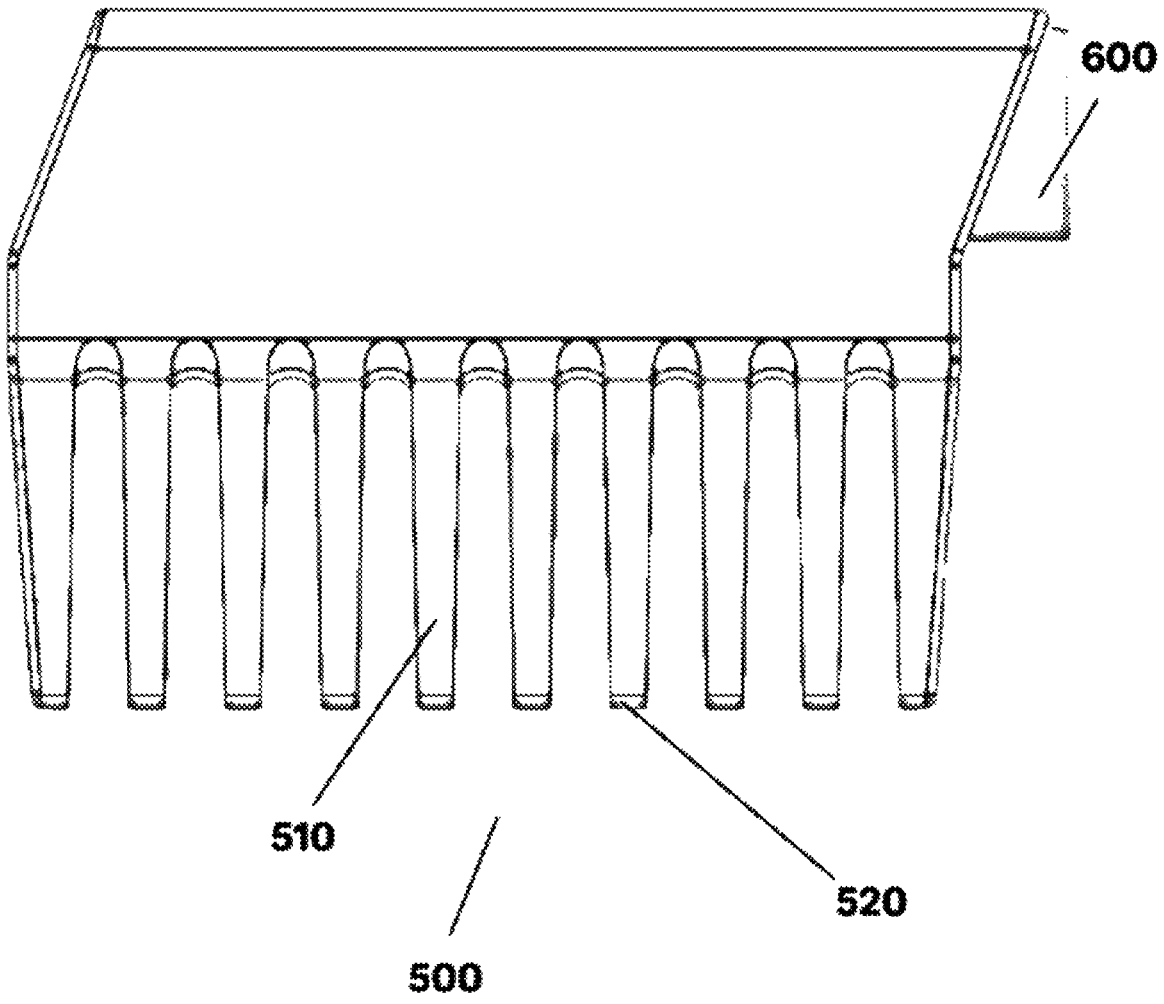
FIG. 6 illustrates an example side view of the haircare system.
Figure 8:
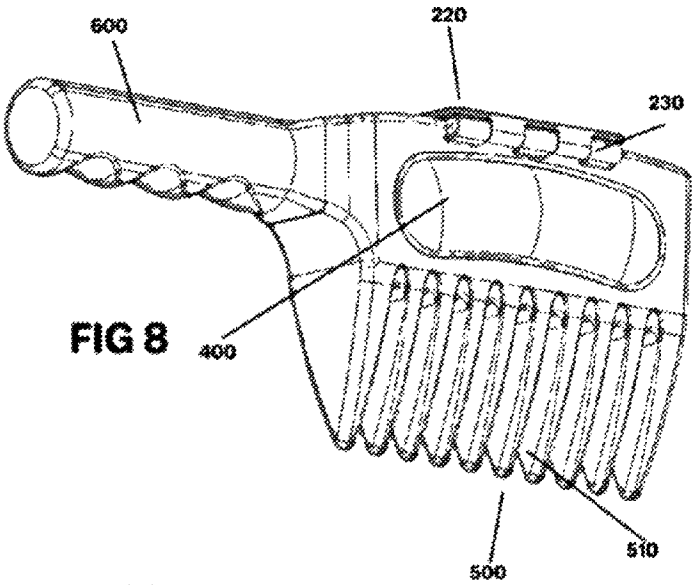
FIG. 8 illustrates an example perspective side view of the haircare system showing a compressible protrusion on the comb body with a handle, and a closed lid.
Figure 10:
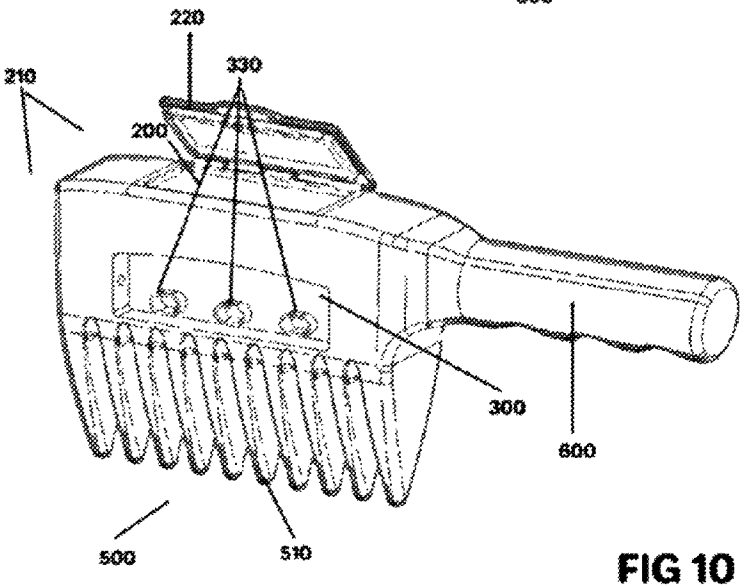
FIG. 10 illustrates an example perspective side view of the haircare system showing a handle, an open lid, a land, and valves within the comb body.
Figure 7:
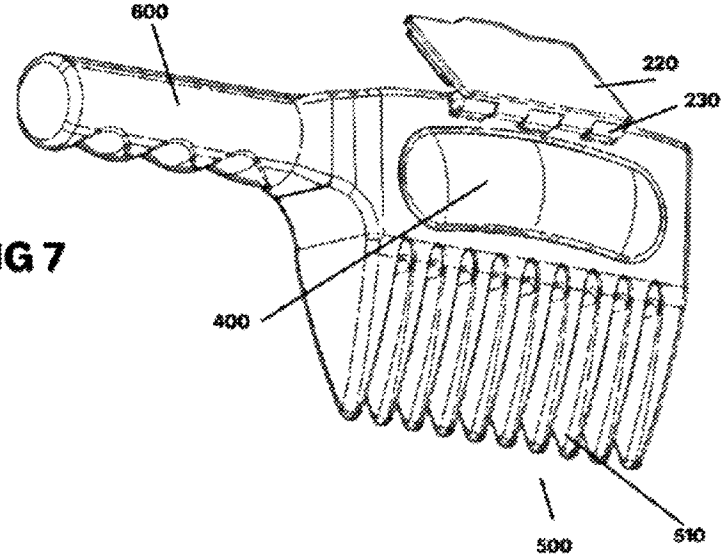
FIG. 7 illustrates an example perspective side view of the haircare system showing a compressible protrusion on the comb body with a handle, and open lid.
Figure 9:
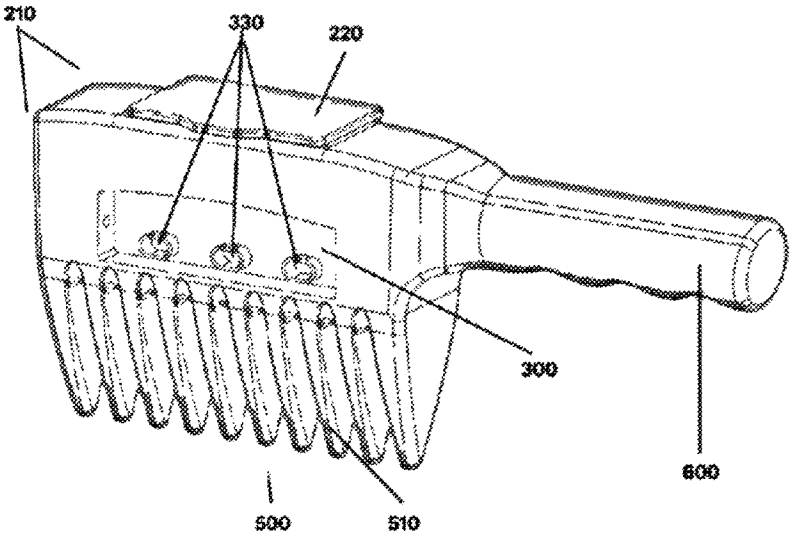
FIG. 9 illustrates an example perspective side view of the haircare system showing a handle, a closed lid, a land, and fluid distribution channels within the comb body.
Figure 12:
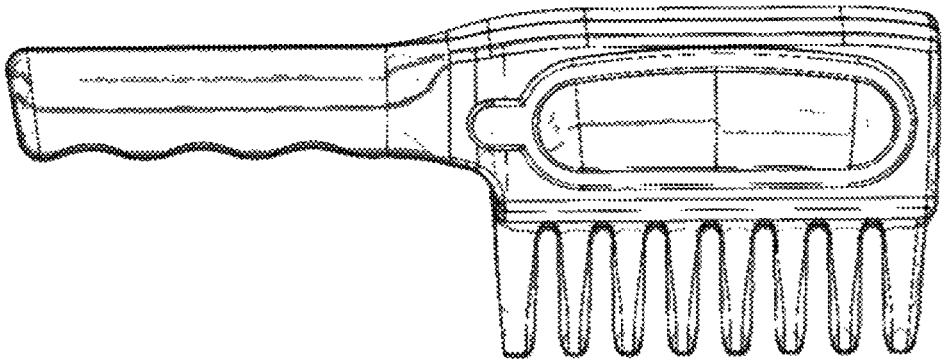
FIGS. 12-14 illustrate an example embodiment of the haircare system showing a removable comb tool.
Figure 13:
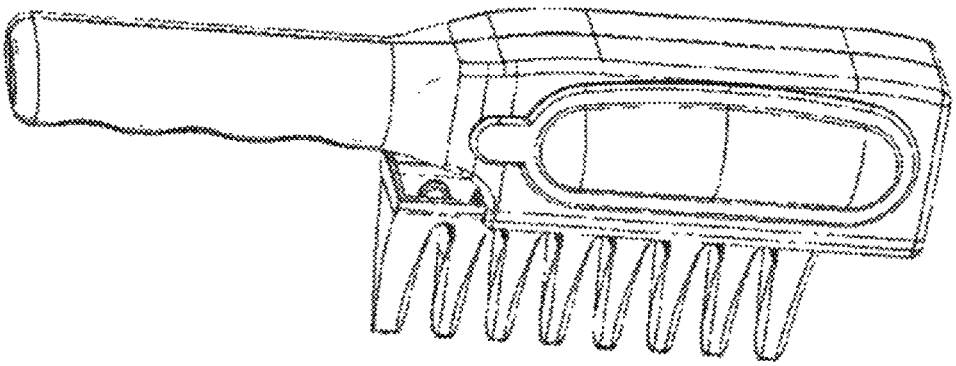
Figure 14:
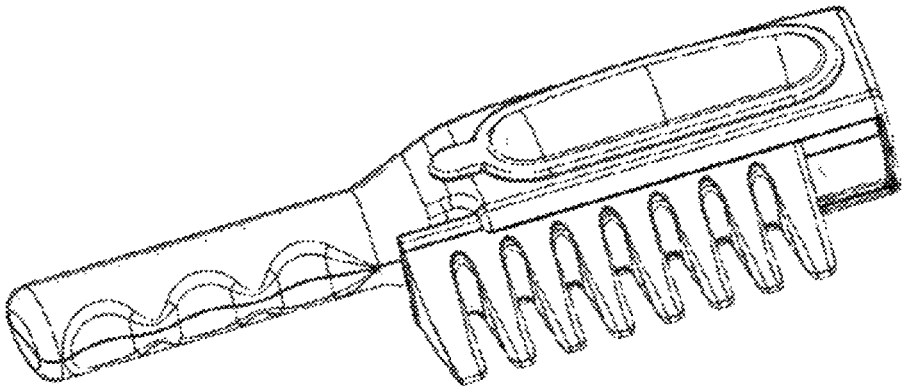

The comb tool 500, may comprise a plurality of teeth 510 and may be arranged in at least one row coupled proximally to the comb body 210. In one aspect, the plurality of teeth 510 may include a circular, semi-circular, spherical, hemispherical, quadrilateral, or conical shape comprising the distal ends. In other embodiments, the teeth 510 may be replaced by or inclusive of other hair elements, such as bristles. In some constructions, hair elements may be elongated with a tapered or uniform body. In other constructions, hair elements may include circular or sinusoidal cross sections, as well as any other desired shape of cross section. As illustrated in FIG. 6, singular tooth 510 may have a quadrilateral cross section 520, or a cross section of any shape, including but not limited to a triangular or a circular cross section that extends uniformly in the direction of the distal ends. In other embodiments, a singular tooth 510 may have a cross section of any shape, including a triangular, circular, or quadrilateral cross section that tapers off in the direction of the distal ends. Each tooth 510 may have a solid or hollow cross-section. In different constructions, the comb tool 500 may have uniform or varied distances between each tooth 510. The teeth 510 may be of a flexible or resilient plastic. In some embodiments, the teeth 510 may be of a flexible or resilient biodegradable material. In further embodiments, the teeth 510 may be of a metal material. Referring to FIGS. 12-14, the comb tool 500 may be removably coupled from comb body 210. FIGS. 12-14 show the comb tool locked in and being removed. Removal allows for changing or cleaning the comb tool 500.

The comb body 210 with land 300, closure mechanism 310, compressible protrusion 400, comb tool 500, handle 600, and lid 220 may each be of the same, similar, or distinct combinations of including but not limited to plastics, such as polypropylene, acrylonitrile butadiene styrene, or other thermoplastics, metals, bamboo, or wood. In further constructions, the comb body 210 including land 300, closure mechanism 310, compressible protrusion 400, teeth 510, lid 220, and handle 600 may each be of combinations of metal, plastic, and biodegradable material. Alternatively, these parts may be attached according to disclosed embodiments by various methods including but not limited to bonding or ultrasonic bonding methods, compression fit, or snaps.

Figure 5:
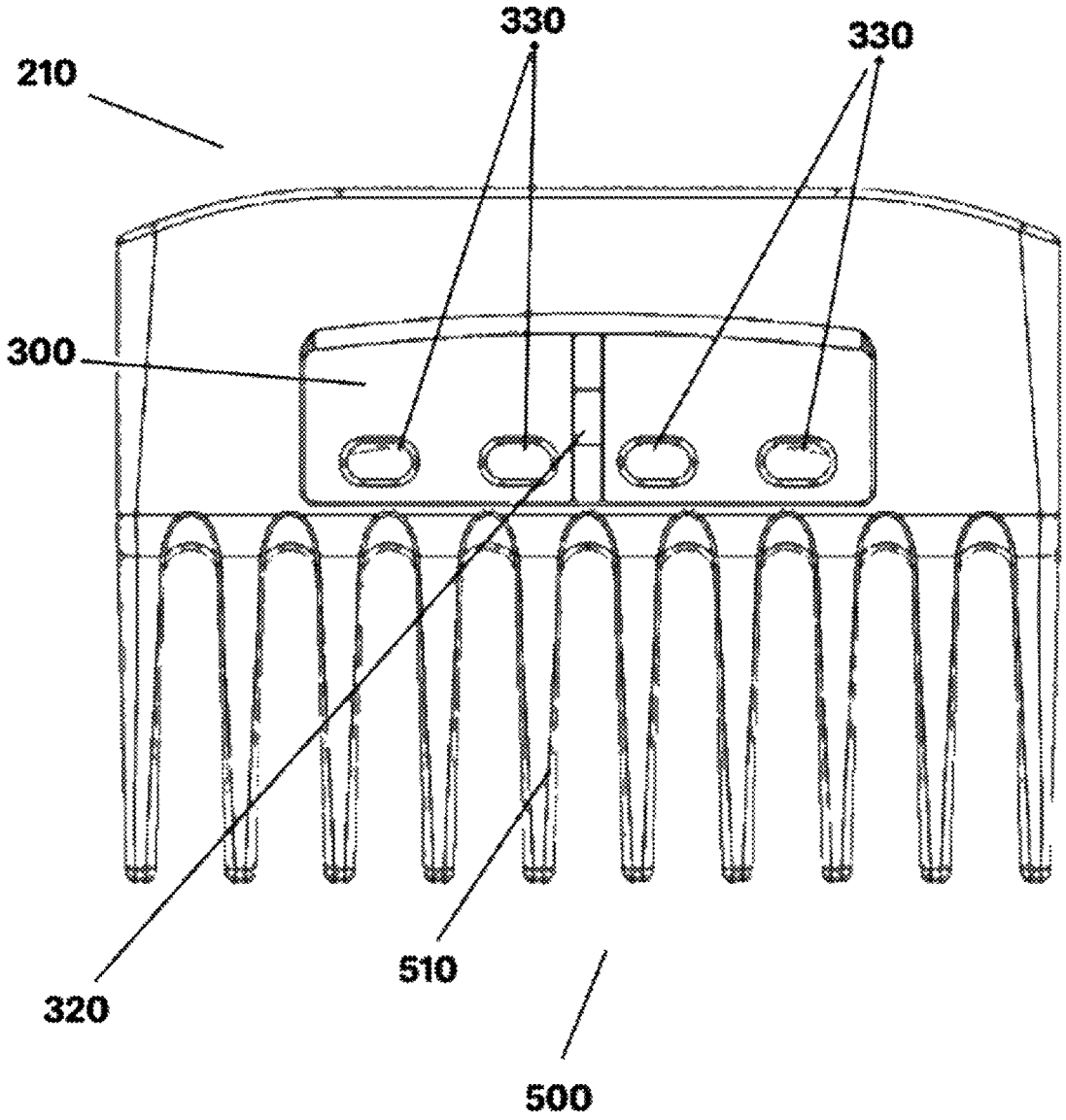
FIG. 5 illustrates an example side view of the haircare system showing a land, structural rib, and fluid distribution channels within the comb body.

Referring to FIGS. 1, 2, 6-11, handle 600 extends proximal to the comb body 210 and orthogonal to comb tool 500. In other embodiments of the system 100, handle 600 extends proximal to comb body 210, but anti-parallel to comb tool 500 in a construction most often referred to as a pick or pik by Afro-descendent peoples. As shown in FIGS. 1, 2, 6-11, the handle 600 may have a variety of constructions. FIG. 2 shows one construction of the system 100 where handle 600 may be detachable and reassembled onto dock 610. Disassembly and reattachment of handle 600 allow for uses of the system 100 with either right-handed or left-handed orientation as desired by the consumer. The dock 610 may form a protrusion on comb body 210 onto which the handle 600 may attach. In other constructions, dock 610 may form a cavity into which handle 600 may attach. Referring to FIGS. 3-5, some embodiments of the system 100 may have no handle at all. The handle 600 may have solid or hollow cross sections.

Referring to FIG. 11, the closure mechanism 310 may include one or more external ducts 340 that open when pressure is placed on the opposing end of closure mechanism 310. The closure mechanism 310 and land 300 may be situated on the side of comb body 210 in such a way that the distribution of solution from ducts 340 does not make contact with hair concurrently with comb tool 500. The benefit of this novel arrangement is that, while in use, the consumer's hair will not build up between comb tool 500 and block the flow of fluid distribution channels 330 or ducts 340. Referring to FIG. 12, the fluid distribution channels 330 and ducts 340 may have a decoupled relationship with comb tool 500 which allows comb tool 500 to be removably coupled with comb body 210 and interchanged with other shapes of teeth without impacting the ability for fluid reservoir 200 to retain haircare solutions. Decoupled contact between fluid distribution channel 330 and comb tool 500 allows the consumer to choose to use different comb tools or different aspects of the system 100.

Referring to FIGS. 7-11, the lid 220 and the fluid reservoir 200 form a substantially fluid-tight seal when functionally joined. FIGS. 7-11 show that the lid 220 and the fluid reservoir 200 may be removably coupled through a snap fit engagement to allow case of operation. Other constructions of the system 100 may have the lid 220 function with a sliding feature in order to seal the fluid reservoir 200. The lid 220 may be attached to the comb body 210 through a hinge 230. The hinge 230 may have a variety of constructions although FIGS. 7-11 depict only a few of them. The lid 220 may attach to the comb body 210 in a variety of structures. Further, the lid 220 and the fluid reservoir 200 may form a substantially fluid-tight seal when functionally joined in a variety of structures that are not limited to their presentation in FIGS. 7-11.

A method for treating hair using a solution dispensing haircare system comprises the steps of obtaining a solution dispensing haircare system comprising a fluid reservoir coupled to a comb body, optionally a handle extending from the comb body, and a comb tool extending from the comb body, wherein the comb body or fluid reservoir comprises a compressible protrusion, the fluid reservoir is fluidly coupled to at least one fluid distribution channel, and the fluid reservoir is coupled to a closure mechanism; filling the fluid reservoir with a fluid or haircare solution; opening the closure mechanism unsealing the at least one distribution channel; optionally applying the comb tool to the hair; compressing the compressible protrusion and dispensing the haircare solution through the distribution channel to hair; applying the haircare solution to the hair with the comb tool; and closing the closure mechanism to seal the at least one distribution channel. In some aspects, the step of filling the fluid reservoir further includes the steps of removing a lid from the fluid reservoir, filling the fluid reservoir and resealing the fluid reservoir with the lid. In further aspects, the compressible protrusion acts as the lid and is removably coupled to the fluid reservoir.

Those of ordinary skill in the art will understand and appreciate the aforementioned description of the invention has been made with reference to certain exemplary embodiments of the invention, which describe a solution dispensing hair care system device and method of use. Those of skill in the art will understand that obvious variations in construction, material, dimensions or properties may be made without departing from the scope of the invention which is intended to be limited only by the claims appended hereto.

The invention claimed is:

1. A solution dispensing haircare system comprising:

a comb body;

a comb tool having a comb tool width, the comb tool coupled to and extending from the comb body;

a fluid reservoir configured to contain and dispense fluid or haircare solution, the fluid reservoir coupled to the comb body;

at least one fluid distribution channel fluidly coupled to the fluid reservoir;

a closure mechanism rotatably coupled to a first lateral side of the comb body within a land of the comb body, further in a closed state, the closure mechanism seals the at least one fluid distribution channel, and in an open or partially open state, a closure mechanism top portion is rotated into the land which in turn rotates a closure mechanism bottom portion away from the at least one fluid distribution channel; and a compressible protrusion coupled to the fluid reservoir, the compressible protrusion configured to compress the fluid reservoir discharging the fluid or haircare solution from the fluid reservoir through the at least one fluid distribution channel.

2. The solution dispensing haircare system of claim 1 wherein the comb tool comprises at least one of a plurality of comb teeth, a brush, a clip, or a haircare styling tool.

3. The solution dispensing haircare system of claim 1 wherein the comb tool is removably coupled to the comb body.

4. The solution dispensing haircare system of claim 1 further comprising a handle extending from comb body.

5. The solution dispensing haircare system of claim 4 wherein the handle is removably coupled to the comb body and may be coupled to either a comb body front surface, comb body rear surface, or comb body top surface.

6. The solution dispensing haircare system of claim 1 wherein the fluid reservoir is removably coupled to the comb body.

7. The solution dispensing haircare system of claim 1 wherein the fluid reservoir is disposed within the comb body or is formed as part of the comb body.

8. The solution dispensing haircare system of claim 7 wherein the at least one fluid distribution channel is disposed on a first lateral side of the comb body.

9. The solution dispensing haircare system of claim 8 wherein the at least one fluid distribution channel extends laterally outside the comb tool width.

10. The solution dispensing haircare system of claim 1 wherein the closure mechanism further comprises at least one duct corresponding to the at least one fluid distribution channel, the at least one duct configured to dispense the fluid or haircare solution outside the comb tool width.

11. The solution dispensing haircare system of claim 1 wherein the closure mechanism comprises a removable cover inserted into or removed from the fluid distribution channel.

12. The solution dispensing haircare system of claim 1 wherein the fluid reservoir or comb body further comprises a lid to open or seal the fluid reservoir.

13. The solution dispensing haircare system of claim 12 wherein the compressible protrusion is configured as the lid.

14. The solution dispensing haircare system of claim 1 wherein a side wall of the fluid reservoir is configured as the compressible protrusion.

15. A method for treating hair using the solution dispensing haircare system of claim 1 comprising the steps of:

filling the fluid reservoir with a fluid or a haircare solution;

opening the closure mechanism unsealing the at least one distribution channel;

optionally applying the comb tool to the hair;

compressing the compressible protrusion and dispensing the fluid or haircare solution through the distribution channel to the hair;

applying the haircare solution to the hair with the comb tool; and closing the closure mechanism to seal the at least one distribution channel.

16. A solution dispensing haircare system comprising:

a comb body;

a comb tool having a comb tool width, the comb tool coupled to and extending from the comb body;

a fluid reservoir configured to contain and dispense fluid or haircare solution, the fluid reservoir coupled to the comb body;

at least one fluid distribution channel fluidly coupled to the fluid reservoir;

a closure mechanism is slideably coupled to the comb body or fluid reservoir and is configured to slide into closed, open, or partially open positions relative to the fluid distribution channel; and a compressible protrusion coupled to the fluid reservoir, the compressible protrusion configured to compress the fluid reservoir discharging the fluid or haircare solution from the fluid reservoir through the at least one fluid distribution channel.

17. The solution dispensing haircare system of claim 16 wherein the comb tool comprises at least one of a plurality of comb teeth, a brush, a clip, or a haircare styling tool.

18. A solution dispensing haircare system comprising:

a comb body;

a comb tool having a comb tool width, the comb tool coupled to and extending from the comb body;

a fluid reservoir configured to contain and dispense fluid or haircare solution, the fluid reservoir coupled to the comb body;

at least one fluid distribution channel fluidly coupled to the fluid reservoir; and a compressible protrusion coupled to the fluid reservoir, the compressible protrusion configured to compress the fluid reservoir discharging the fluid or haircare solution from the fluid reservoir through the at least one fluid distribution channel, and the compressible protrusion is further configured as a lid to open or seal the fluid reservoir.

19. The solution dispensing haircare system of claim 18 wherein the comb tool comprises at least one of a plurality of comb teeth, a brush, a clip, or a haircare styling tool.

20. A method for treating hair using the solution dispensing haircare system of claim 18 comprising the steps of:

filling the fluid reservoir with a fluid or a haircare solution;

opening the closure mechanism unsealing the at least one distribution channel;

optionally applying the comb tool to the hair;

compressing the compressible protrusion and dispensing the fluid or haircare solution through the distribution channel to the hair;

applying the haircare solution to the hair with the comb tool; and closing the closure mechanism to seal the at least one distribution channel.

* * * * *